United States Patent [19]

Chang et al.

[11] Patent Number: 4,622,079

[45] Date of Patent: Nov. 11, 1986

[54] METHOD FOR THE DISPERSION OF HARD ALPHA DEFECTS IN INGOTS OF TITANIUM OR TITANIUM ALLOY AND INGOTS PRODUCED THEREBY

[75] Inventors: Winston H. Chang, Cincinnati, Ohio; Robert A. Sprague, Danvers, Mass.; Joseph A. Stahl, Cincinnati, Ohio

[73] Assignee: General Electric Company, Cincinnati, Ohio

[21] Appl. No.: 714,758

[22] Filed: Mar. 22, 1985

[51] Int. Cl.[4] ..... C22F 1/18

[52] U.S. Cl. ..... 148/11.5 F; 148/133

[58] Field of Search ..... 148/11.5 F, 12.7 B, 148/133

[56] References Cited

U.S. PATENT DOCUMENTS

| | | | |
|---|---|---|---|
| 3,481,799 | 12/1969 | Day et al. | 148/11.5 F |
| 4,309,226 | 1/1982 | Chen | 148/12.7 B |
| 4,482,398 | 11/1984 | Eylon et al. | 148/133 |

*Primary Examiner*—L. Dewayne Rutledge
*Assistant Examiner*—Robert L. McDowell
*Attorney, Agent, or Firm*—Stephen S. Strunck; Derek P. Lawrence

[57] ABSTRACT

A method consisting of a high temperature diffusion treatment, preferably preceded by a hot isostatic pressing treatment, by which the deleterious effects of hard alpha defects may be substantially reduced or eliminated from ingots of titanium or titanium alloys without adversely affecting the subsequent structure and properties of ingots processed by the method and the homogenized, substantially hard alpha and inclusion-free ingots produced thereby.

27 Claims, 10 Drawing Figures

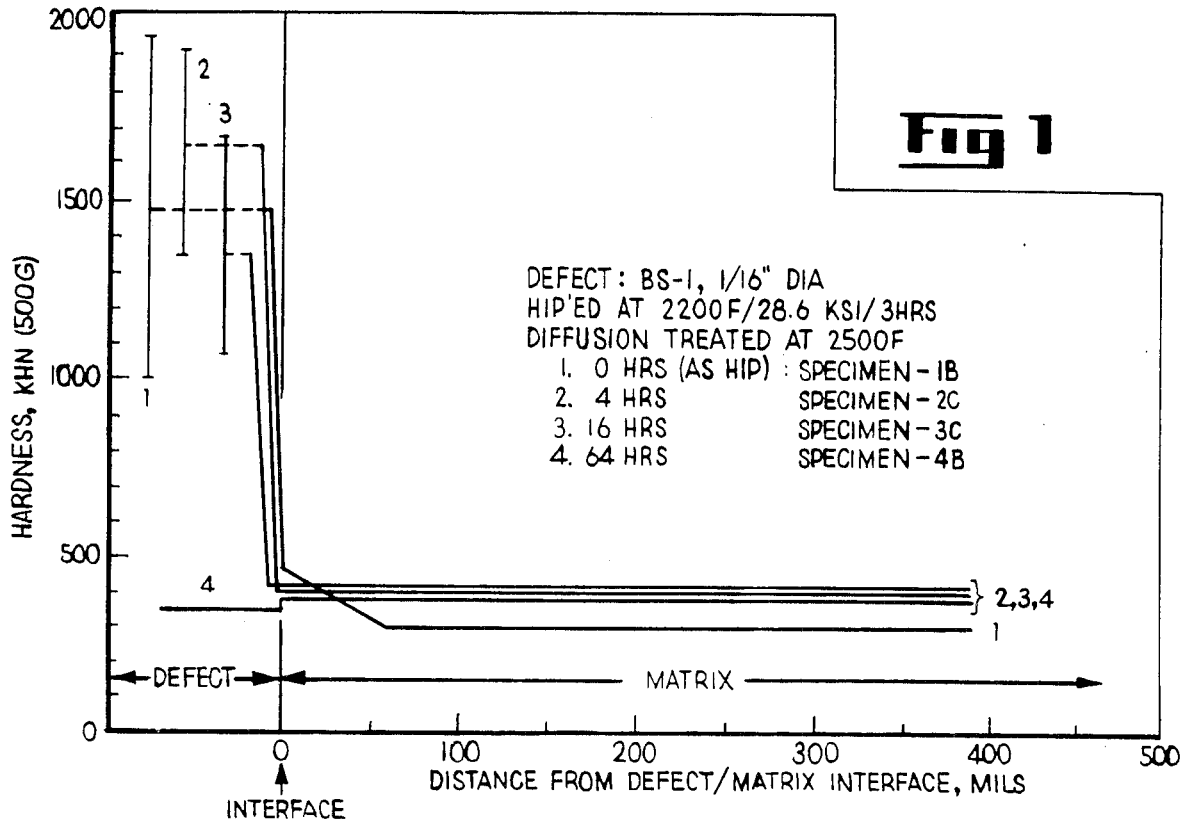
Fig 1
HARDNESS, KHN (500G)
2000
1500
1000
500
0
DEFECT: BS-1, 1/16" DIA
HIP'ED AT 2200F/28.6 KSI/3HRS
DIFFUSION TREATED AT 2500F
1. 0 HRS (AS HIP) : SPECIMEN-1B
2. 4 HRS SPECIMEN-2C
3. 16 HRS SPECIMEN-3C
4. 64 HRS SPECIMEN-4B
2,3,4
1
DEFECT
MATRIX
0
100
200
300
400
500
INTERFACE
DISTANCE FROM DEFECT/MATRIX INTERFACE, MILS

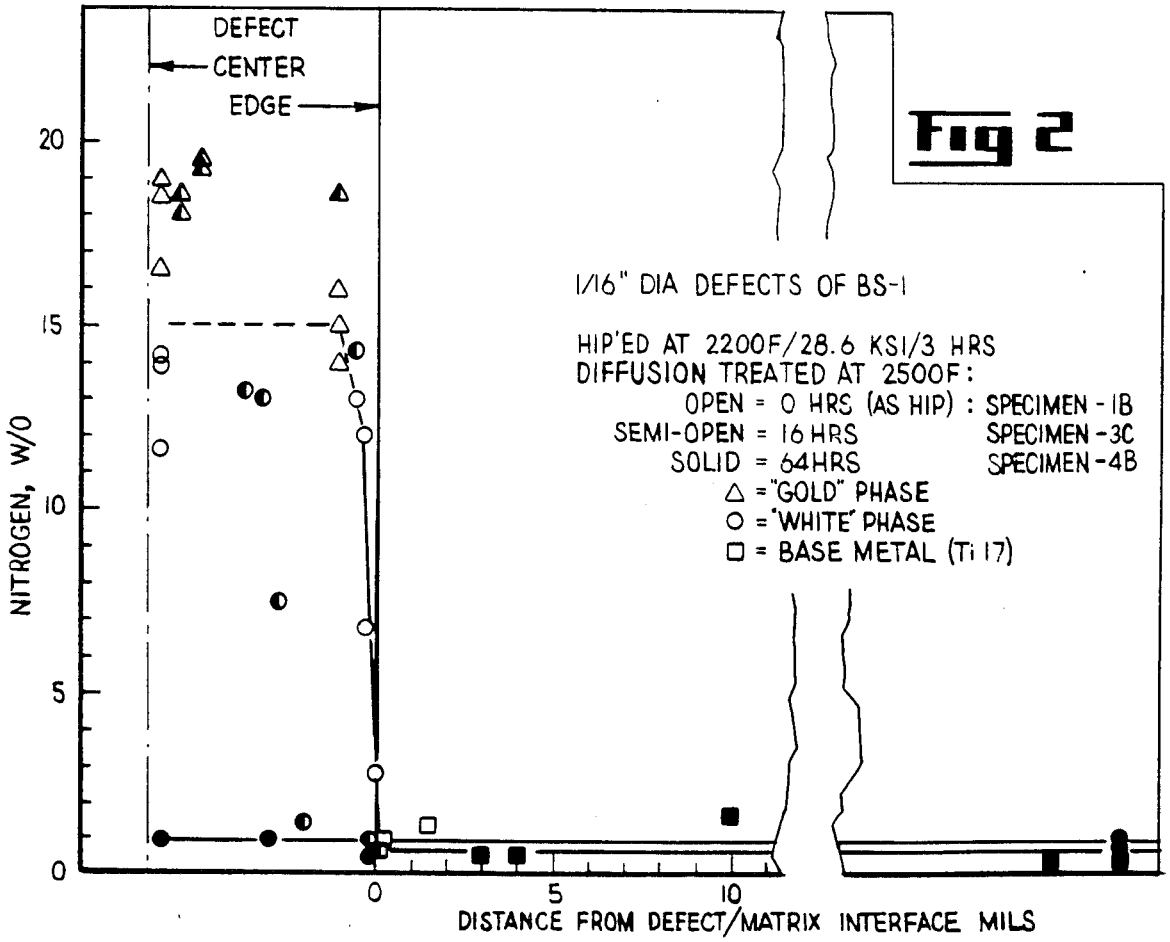
Fig 2
DEFECT
CENTER
EDGE
NITROGEN, W/O
20
15
10
5
0
1/16" DIA DEFECTS OF BS-1
HIP'ED AT 2200F/28.6 KSI/3 HRS
DIFFUSION TREATED AT 2500F:
OPEN = 0 HRS (AS HIP) : SPECIMEN-1B
SEMI-OPEN = 16 HRS SPECIMEN-3C
SOLID = 64HRS SPECIMEN-4B
△ = "GOLD" PHASE
○ = "WHITE" PHASE
□ = BASE METAL (Ti 17)
0
5
10
DISTANCE FROM DEFECT/MATRIX INTERFACE MILS

METHOD FOR THE DISPERSION OF HARD ALPHA DEFECTS IN INGOTS OF TITANIUM OR TITANIUM ALLOY AND INGOTS PRODUCED THEREBY

BACKGROUND OF THE INVENTION

Compared to iron and nickel base alloys, various titanium alloys have favorable combinations of high strength, toughness, corrosion resistance and strength-to-weight ratios which render them especially suitable for aircraft, aerospace and other high-performance applications at very low to moderately elevated temperatures. For example, titanium alloys which have been tailored to maximize strength efficiency and metallurgical stability at elevated temperatures, and which thus exhibit low creep rates and predictable stress rupture and low-cycle fatigue behavior, are increasingly being used as rotating components in gas turbine engines.

After processing, titanium alloys are generally classified microstructurally as alpha, near-alpha, alpha-beta or beta. The class of the alloy is principally determined by alloying elements which modify the alpha (close-packed hexagonal crystal structure) to beta (body-centered cubic crystal structure) allotropic transformation which occurs at about 885° C. (1625° F.) in unalloyed titanium. Alpha alloys, alloyed with such alpha stabilizers as aluminum, tin, or zirconium, contain no beta phase in the normally heat-treated condition. Near-alpha or supra-alpha alloys, which contain small additions of beta stabilizers, such as molybdenum or vanadium, in addition to the alpha stabilizers, form limited beta phase on heating and may appear microstructurally similar to alpha alloys. Alpha-beta alloys, which contain one or more alpha stabilizers or alpha-soluble elements plus one or more beta stabilizers, consist of alpha and retained or transformed beta. Beta alloys tend to retain the beta phase on initial cooling to room temperature, but generally precipitate secondary phases during heat treatment.

The three major steps in the production of titanium and titanium alloys are the reduction of titanium ore to a porous form of titanium called sponge; the melting of sponge including, if desired, reclaimed titanium scrap (revert) and alloying additions to form ingot; and the formation of finished shapes as by remelting and casting or by mechanically working the ingots first into general mill products such as billet, bar and plate by such primary fabrication processes as cogging and hot rolling and then into finished parts by such secondary fabrication processes as die forging and extrusion.

Since many elements, even in small amounts, can have major effects on the properties of titanium and titanium alloys in finished form, control of raw materials is extremely important in producing titanium and its alloys. For example, the elements carbon, nitrogen, oxygen, silicon and iron, commonly found as residual elements in sponge, must be held to acceptably low levels since those elements tend to raise the strength and lower the ductility of the final product. Carbon and nitrogen are particularly minimized to avoid embrittlement.

Control of the melting process is also critical to the structure, properties and performance of titanium and titanium-base alloys. Thus, most titanium and titanium alloy ingots are melted twice in an electric-arc furnace under vaccum by the process known as the double consumable-electrode vacuum-melting process. In this two-stage process, titanium sponge, revert and alloy additions are initially mechanically consolidated and then melted together to form ingot. Ingots from the first melt are then used as the consumable electrodes for second-stage melting. Processes other than consumable-electrode arc melting are used in some instances for first-stage melting of ingot for noncritical applications, but in any event the final stage of melting must be done by the consumable-electrode vacuum-arc process. Double melting is considered necessary for all critical applications to ensure an acceptable degree of homogeneity in the resulting product. Triple melting is used to achieve even better uniformity and to reduce oxygen-rich or nitrogen-rich inclusions in the microstructure to very low levels. Melting in a vacuum reduces the hydrogen content of titanium and essentially removes other volatiles, thus producing higher purity in the cast ingot.

Titanium and its alloys are prone to the formation of defects and imperfections and, despite the exercise of careful quality control measures during melting and fabrication, defects and imperfections are infrequently and sporadically found in ingot and finished product. A general cause of defects and imperfections is segregation in the ingot. It is conventional wisdom that segregation in titanium ingot is particularly detrimental and must be controlled because it leads to several different types of imperfections that cannot readily be eliminated either by homogenizing heat treatments or by combinations of heat treatment and primary mill processing.

Type I imperfections, usually called "high interstitial defects" or "hard alpha," are regions of interstitially stabilized alpha phase that have substantially higher hardness and lower ductility than the surrounding matrix material. These imperfections are also characterized by high local concentrations of one or more of the elements nitrogen, oxygen or carbon. Although type I imperfections sometimes are referred to as "low-density inclusions," they often are of higher density than is normal for the alloy. In addition to segregation in the ingot, type I defects may also be introduced during sponge manufacture (e.g., retort leaks and reaction imbalances), heat formulation and electrode fabrication (e.g., during welding to join electrode pieces) and during melting (e.g., furnace malfunctions and melt drop-ins).

Type II imperfections, sometimes called "high aluminum defects," are abnormally stabilized alpha-phase areas that may extend across several beta grains. Type II imperfections are caused by segregation of metallic alpha stabilizers, such as aluminum, contain an excessively high proportion of primary alpha and are slightly harder than the adjacent matrix. Sometimes, type II imperfections are accompanied by adjacent stringers of beta which are areas low in both aluminum and hardness. This condition is generally caused by the migration of alloy constituents having high vapor pressures into closed solidification pipe followed by incorporation into the microstructure as stringers during primary mill fabrication.

Type I and type II imperfections are not acceptable in aircraft-grade titanium and titanium alloys because they degrade critical design properties. Hard alpha inclusions, for instance, tend to cause premature low cycle fatigue (LCF) initiation. Hard alpha inclusions are particularly detrimental as they are infrequently and sporadically found in ingot and finished product despite the exercise of careful quality control measures during the melting and fabrication and since, prior to the invention of the invention set forth herein, there was no known method to render harmless "melted-in" hard alpha defects.

Beta flecks, another type of imperfection, are small regions of stabilized beta in material that has been processed in the alpha-beta region of the phase diagram and heat treated. In size, they are equal to or larger than prior beta grains. Beta flecks are either devoid of primary alpha or contain less than some specified minimum level of primary alpha. They are localized regions which are either abnormally high in beta-stabilizer content or abnormally low in alpha-stabilizer content. Beta flecks are attributed to microsegregation during solidification of ingots of alloys that contain strong beta stabilizers and are most often found in products made from large-diameter ingots. Beta flecks also may be found in beta-lean alloys such as Ti-6Al-4V that have been heated to a temperature near the beta transus during processing. Beta flecks are not considered harmful in alloys lean in beta stabilizers if they are to be used in the annealed condition. On the other hand, they constitute regions that incompletely respond to heat treatment, and for this reason microstructural standards have been established for allowable limits on beta flecks in various alpha-beta alloys. Beta flecks are more objectionable in beta-rich alpha-beta alloys than in leaner alloys.

SUMMARY OF THE INVENTION

This invention provides a method by which the deleterious effects of hard alpha defects may be substantially minimized or eliminated from ingots of titanium or titanium alloys without adversely affecting the subsequent structure and properties of ingots processed by the method. The method of the invention thus produces homogenized, substantially hard alpha and inclusion-free ingots of titanium or titanium alloy.

The process generally consists of soaking titanium or titanium alloy ingots at specific temperatures for specific periods of time to convert, by diffusion, the hard alpha defects into regions having composition and structure essentially identical to those of the base alloy, i.e., matrix, surrounding the defects. The diffusion treatment is preferably carried out at the ingot stage to minimize grain coarsening and also to take maximum advantage of homogenization and thus improved workability resulting from the diffusion treatment. The diffusion treatment is carried out in vacuum or inert atmosphere and is preferably preceded by a hot isostatic pressing (HIP) operation to eliminate porosity which is usually found around hard alpha defects, thereby facilitating subsequent diffusion.

The diffusion temperature and time parameters have general ranges of 2500° to 2800° F. and 24 to 200 hours, respectively. If the temperature dependent diffusivity of nitrogen in the titanium alloy is known, the diffusion treatment time can be estimated from the equation:

$$\text{Diffusion time (hrs)} = [(C_i - C_f)/C_f](r^2/D)(1/3600)$$

where $C_i$ is the initial maximum (max.) nitrogen content in the defect (weight %);

$C_f$ is the desired final max. nitrogen content after diffusion (weight %);

r is the initial defect radius (cm); and

D is the nitrogen diffusivity in the Ti alloy matrix ($cm^2$/sec)

The major advantages of the process are minimization or elimination of hard alpha defects or inclusions; homogenization of the entire ingot which eliminates beta flecking, improves workability, and improves structural and property homogeneity; and reduction in nondestructive testing (NDT) costs.

BRIEF DESCRIPTION OF THE DRAWINGS

FIG. 1 is a graph of hardness as a function of the distance from the interface between seeded BS-1 defects in a Ti-17 matrix and diffusion treatment time;

FIG. 2 is a graph of nitrogen concentration as a function of the distance from the interface between seeded BS-1 defects in a Ti-17 matrix and diffusion treatment time;

DETAILED DESCRIPTION OF THE INVENTION

Figure 3A:
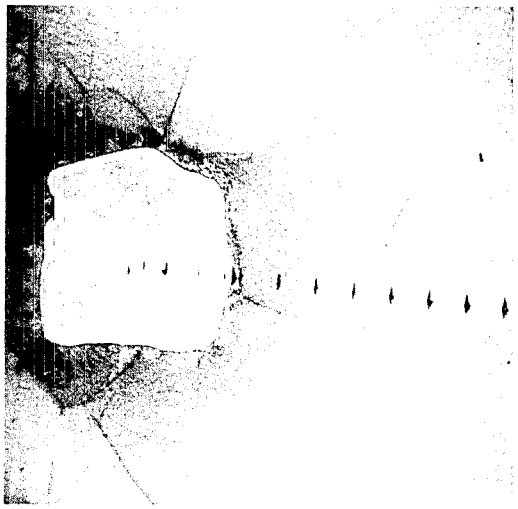
FIG. 3 is a series of photomicrographs showing the effect of diffusion treatment time at 2500° F. on Ti-17 containing seeded defects of N-1 material wherein FIG. 3A at 25× is of the defect plus matrix in the as-HIP condition (2200° F./29 ksi/3 hrs), FIG. 3B at 25× is of the region of FIG. 3A after HIP plus 16 hours of diffusion.
FIG. 3C at 31.5× is of the region of FIG. 3A after HIP plus 64 hours of diffusion.
FIG. 3D is the center of the defect region of FIG. 3C at 1000×.
Figure 3B:
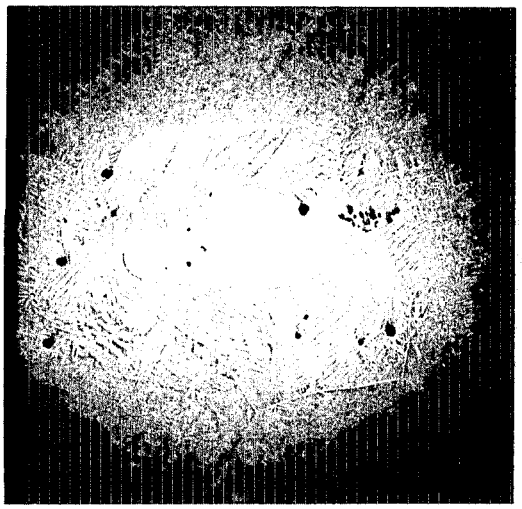
Figure 3C:
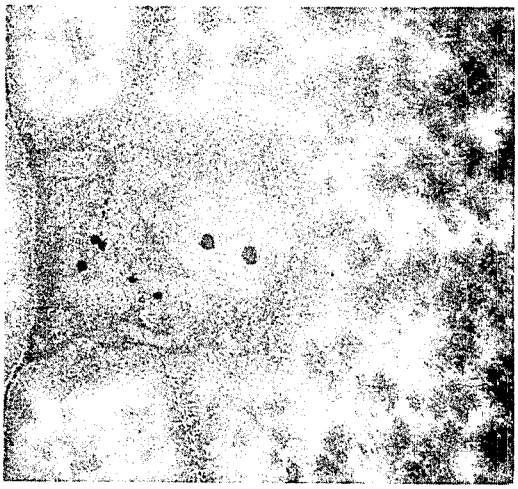
Figure 3D:
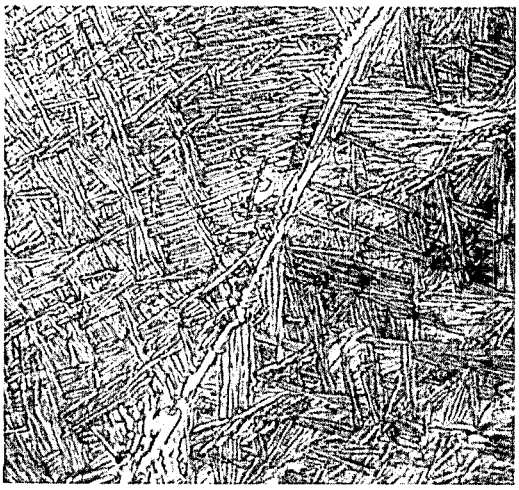

The invention is generally intended to be practiced as a matter of routine processing of ingots of titanium and titanium alloy, especially where defects of the hard alpha type would be detrimental to the service life of finished parts made from the ingot since such defects are observed randomly and periodically despite the exercise of utmost care during ingot fabrication and processing.

In the practice of the method of the invention, the ingots are first brought to a substantially uniform temperature in the range of about 2500° to 2800° F. and maintained at that temperature for a period of time sufficient to homogenize the hard alpha defects and the region of base alloy surrounding the defects. Homogenization results from the outward diffusion of interstitial elements, such as oxygen and nitrogen, and the inward diffusion of alloying elements. The diffusion treatment is carried out in vacuum or inert atmosphere and preferably at the ingot stage to minimize grain coarsening and also to take maximum advantage of the improved workability resulting from the diffusion treatment. The diffusion treatment is preferably preceded by a hot isostatic pressing (HIP) operation to eliminate porosity which is usually found around hard alpha defects, thereby facilitating subsequent diffusion. The HIP treatment is conducted in the temperature range of from about 2000° to 2500° F., preferably 2200° F., at isostatic pressures of from about 10–30 kilopounds per square inch (ksi), preferably 15 ksi, and for from 2 to 4 hours, preferably 3 hours.

The diffusion temperature and time parameters are in the range of from about 2500° to 2800° F., preferably 2700° F., and from 24–200 hours, preferably 100 hours. If the temperature dependent diffusivity of nitrogen in the titanium alloy is known, the diffusion treatment time can be estimated from the equation:

$$\text{Diffusion time (hrs)} = [(C_i - C_f)/C_f](r^2/D)(1/3600)$$

where $C_i$ is the initial max. nitrogen content in the defect (weight %);

$C_f$ is the desired final max. nitrogen content after diffusion (weight %);

r is the initial defect radius (cm); and

D is the nitrogen diffusivity in the Ti alloy matrix ($cm^2$/sec)

The nitrogen diffusivity, D, can be determined experimentally. For a Ti-16% N defect in Ti-17 alloy, D is about $3.3\times10^{-6}$ $cm^2$/sec at 2650° F. and $5.5\times10^{-6}$ $cm^2$/sec at 2750° F. The diffusivity of nitrogen was chosen because the major and most harmful element in hard alpha defects is nitrogen, thus nitrogen diffusion is the limiting factor in the maximization of the benefits obtainable from the method of the present invention.

To afford those skilled in the art a better appreciation of the invention, and of the manner of best using it, the following illustrative examples are given.

EXAMPLES 1–12

In Example 1, a block of Ti-17 alloy measuring 2" long×¾" wide×½" thick was prepared by drilling therein from one of the 2×¾ faces four holes measuring ⅛" dia×¼" deep, 1/16"×1/16", 1/16"×⅛" and ¼"×⅛". Into those holes, there was packed granulated defect materials having the compositions shown in Tables I and II to simulate hard alpha defects. Thereafter, a coverplate of Ti-17 alloy measuring 2" long×¾" wide×¼" thick was placed over the open holes and an electron beam weld was made to fuse (seal) the joint between the block and the coverplate. The thusly completed specimen was subjected to a HIP treatment at 2200° F. and 29 ksi for 3 hours. The other specimens of Examples 2–12 were similarly fabricated using the hole arrangements and defect materials listed in Table II, the compositions of which are more specifically set forth in Table I. The specimens of Examples 2–12 were subjected to the HIP/Diffusion cycles listed in Table II.

The specimens of Examples 1–12 were sectioned and the effectiveness of the HIP/Diffusion treatments was determined by microhardness traverses, optical and scanning electron microscopy and by microprobe analyses. In sum, the data from the specimens of Example 1 showed that a treatment consisting only of a HIP cycle of 2200° F./29 ksi/3 hrs was insufficient to diffuse away the defects, but that a HIP cycle followed by a diffusion treatment was effective in causing sufficient diffusion of interstitial elements outward and into the matrix and diffusion of metallic alloying elements from the matrix into the defect area to convert the defect to Ti-17. Concomitantly, the hardness in the areas where the defects had been located decreased to levels that were substantially equal to those of the matrix material.

TABLE I

COMPOSITIONS AND CHARACTERISTICS OF MATERIALS (W/O)

| Alloy or Defect | Code | Description | Al | V | Mo | Cr | Sn | Zr | Fe | O | N | C | Ti |
|---|---|---|---|---|---|---|---|---|---|---|---|---|---|
| Ti—6Al—4V | | | 6.0 | 4.0 | — | — | — | — | ≦0.30 | ≦0.20 | ≦0.05 | ≦0.10 | bal |
| Ti—17 | | | 5.0 | — | 4.0 | 4.0 | 2.0 | 2.0 | ≦0.30 | ≦0.13 | ≦0.04 | ≦0.05 | bal |
| Burnt Sponge | BS-1 | Brilliant gold/ yellow/grey | | | | | | | | 6.4 | 15.3 | | bal |
| " | BS-2 | Grey | | | | | | | | 1.5 | 5.6 | | bal |
| " | BS-3 | Light gold | | | | | | | | 1.0 | 15.8 | | bal |
| " | BS-5 | Light grey | | | | | | | | 6.9 | 9.3 | | bal |
| Nitrided Sponge | NS-6 | Greyish gold | | | | | | | | 0.16 | 11.5 | | bal |
| Nitrided Sponge | NS-7 | Greyish gold | | | | | | | | 0.23 | 16.5 | | bal |
| Ti—N Binary | N-1 | Grey | | | | | | | | 0.29 | 9.1 | | bal |
| Contaminated Weld Metal | W-1 | Surface layer of weld made in air | | | | | | | | — | 6.1 | | bal |
| Contaminated Weld Metal | W-2 | Surface layer of weld made in ⅛ pumped down chamber | | | | | | | | 0.52 | 1.2 | | bal |

TABLE II

HIP AND DIFFUSION CONDITIONS

| Example | Specimen No. | Defect Size, In. Dia. | Defect Size, In. Depth | Defect Material | HIP Conditions °F./Ksi/Hrs | Diffusion Conditions °F./Hrs |
|---|---|---|---|---|---|---|
| 1 | 1-A | ¼ | ⅛ | BS-1 | 2200/29/3 | None |
| | 1-B | 1/16 | ⅛ | BS-1 | " | " |
| | 1-C | 1/16 | 1/16 | N-1 | " | " |
| | 1-D | ⅛ | ¼ | N-1 | " | " |
| 2 | 2-A | ¼ | ⅛ | BS-1 | " | 2500/4 |
| | 2-B | 1/16 | ⅛ | N-1 | " | " |
| | 2-C | 1/16 | 1/16 | BS-1 | " | " |
| | 2-D | ⅛ | ¼ | N-1 | " | " |
| 3 | 3-A | ¼ | ⅛ | N-1 | " | 2500/16 |
| | 3-B | 1/16 | ⅛ | N-1 | " | " |

TABLE II-continued

| Example | Specimen No. | HIP AND DIFFUSION CONDITIONS Defect Size, In. Dia. | Depth | Defect Material | HIP Conditions °F./Ksi/Hrs | Diffusion Conditions °F./Hrs |
|---|---|---|---|---|---|---|
| | 3-C | 1/16 | 1/16 | BS-1 | " | " |
| | 3-D | 1/8 | 1/4 | BS-1 | " | " |
| 4 | 4-A | 1/4 | 1/8 | BS-1 | " | 2500/64 |
| | 4-B | 1/16 | 1/8 | BS-1 | " | " |
| | 4-C | 1/16 | 1/16 | W-1 | " | " |
| | 4-D | 1/8 | 1/4 | W-1 | " | " |
| 5 | 5-C | 1/16 | 1/16 | N-1 | " | " |
| | 5-D | 1/8 | 1/4 | N-1 | " | " |
| 6 | 6-B | 1/16 | 1/8 | BS-2 | 2200/15/3 | None |
| | 6-C | 1/16 | 1/16 | BS-3 | " | " |
| | 6-D | 1/8 | 1/4 | BS-5 | " | " |
| 7 | 7-B | 1/16 | 1/8 | BS-1 | " | 2600/32 |
| | 7-C | 1/16 | 1/16 | BS-2 | " | " |
| | 7-D | 1/8 | 1/4 | W-2 | " | " |
| 8 | 9-A | 1/4 | 1/8 | BS-2 | " | 2775/24 |
| | 9-B | 1/16 | 1/8 | BS-3 | " | " |
| | 9-C | 1/16 | 1/16 | BS-1 | " | " |
| | 9-D | 1/8 | 1/4 | BS-5 | " | " |
| 9 | 12-A | 1/4 | 1/4 | BS-5 | ←2700/26/50→ | |
| | 12-B | 1/8 | 1/2 | BS-1 | " | |
| 10 | 13-A | 1/4 | 1/4 | BS-5 | 2500/26/4 | 2150/50 |
| | 13-B | 1/8 | 1/2 | BS-1 | " | " |
| 11 | 14-A | 0.1 | 0.5 | BS-1 | 2500/15/4 | None |
| | 14-B | 0.1 | 0.5 | BS-5 | " | " |
| 12 | 16-A | 0.1 | 1 | BS-1 | " | 2650/100 |
| | 17-A | 0.1 | 1 | BS-5 | " | " |

Typical data showing changes in hardness and nitrogen content are shown in FIGS. 1 and 2, respectively. FIG. 3 shows typical changes in microstructure as a function of diffusion treatment time at 2500° F. for Ti-17 containing 1/16" dia. seeded defects of N-1 material. Table III summarizes the ranges and most preferred HIP and diffusion treatments resulting from Examples 1–12. The grain size of the samples increased markedly during the diffusion treatment. This is not considered objectionable, however, when the diffusion treatment is applied at the ingot stage (as preferred), because grain refinement will be accomplished by primary working.

TABLE III

| | HIP AND DIFFUSION PARAMETERS HIP Range | HIP Preferred | DIFFUSION Range | DIFFUSION Preferred |
|---|---|---|---|---|
| Temp (°F.) | 2200–2500 | 2200 | 2500–2800 | 2700 |
| Pressure (ksi) | 10–30 | 15 | N/A | N/A |
| Time (hrs) | 2–4 | 3 | 24–200 | 100 |

EXAMPLE 13

Figure 4:
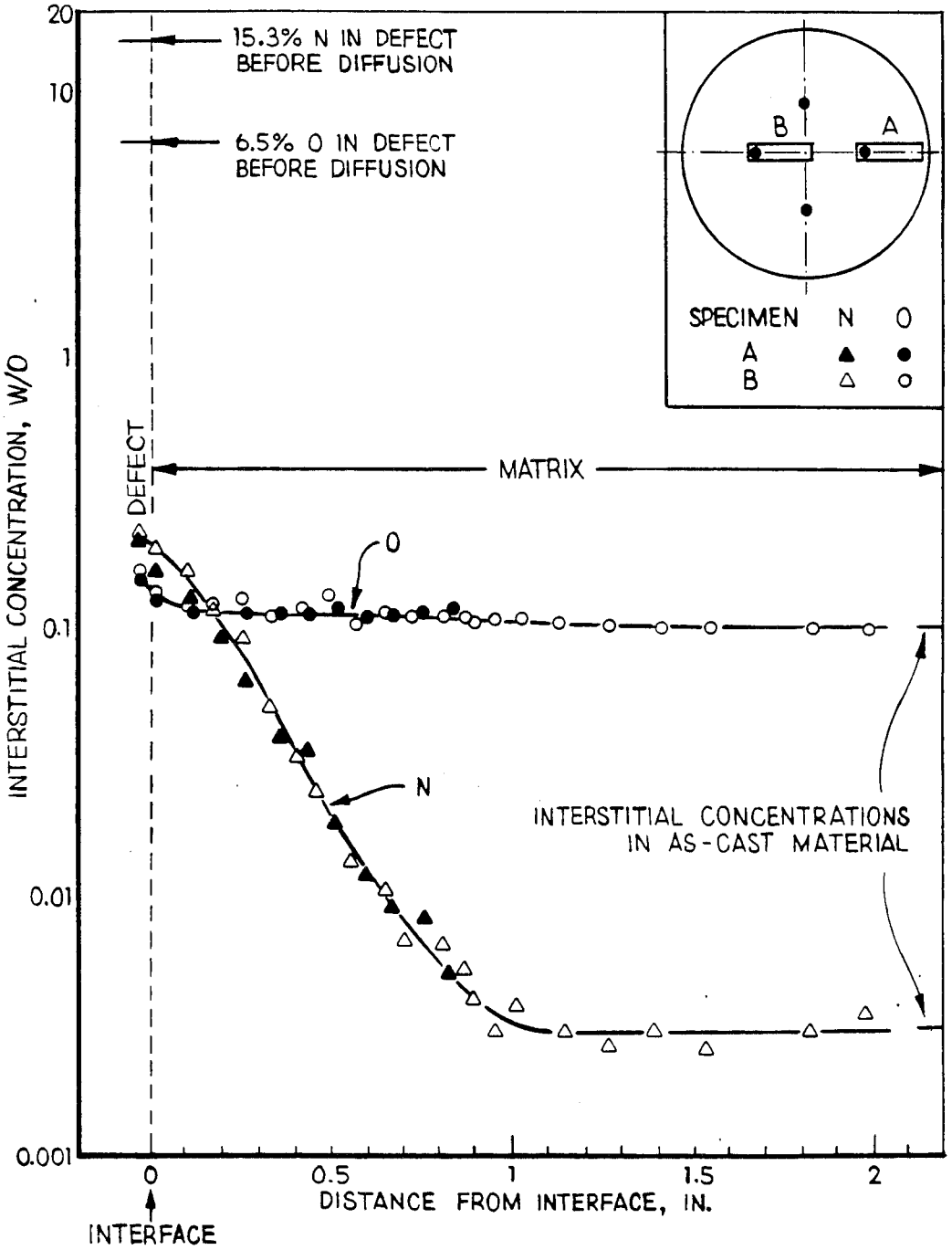
FIG. 4 is a graph of nitrogen and oxygen concentration as a function of the distance from the interface between seeded BS-1 defects in a Ti-17 matrix following a combined HIP plus diffusion treatment of 2650° F./15 ksi/100 hours.

A subscale ingot (8 inch diameter × 15 inch length) of Ti-17 containing seeded hard alpha defects was made. On one of the 8-inch diameter faces perpendicular diameter lines were scribed and four holes 0.1 inch in diameter spaced on the diameter lines 2 inches from the center of the face were drilled 7 inches deep into the ingot (see FIG. 4). The holes were then packed with granular BS-1 defect material and a 1 inch thick coverplate was electron beam welded onto the ingot to cover and seal the holes.

The ingot was then subjected to a combined HIP and diffusion cycle of 2650° F. and 15 ksi for 100 hours. A disk-like slice about ½ inch thick was then cut from the ingot to provide specimens for metallographic examination and gas analysis. To perform the gas analysis, ½ inch long by 0.07 inch diameter cylindrical specimens of the defect core were removed by electrode discharge machining parallel to the cylindrical axis of the disk. Cylinders of the matrix alloy 3/16 inch in diameter extending perpendicularly from the defect core to the edge of the slice and from the defect core to the center of the ingot were also removed by machining. Chemical analysis of the cylindrical core and matrix samples showed the decreases in nitrogen and oxygen levels depicted in FIG. 4. The ingot was subsequently drawn to 5 in. square at 2100° F., followed by $\alpha+B$ forging to 2.5 inch diameter stock at 1500° F. Metallographic examination of a disk-like sample removed from the forged ingot showed traces of the original defect and some cracks that formed during forging, indicating that the diffusion treatment had not been sufficient to disperse the defect adequately and that the $\alpha+B$ forging temperature was too low.

The 2.5 inch diameter billet was then subjected to a second HIP treatment of 1750° F./15 ksi/3 hrs. to heal the microcracks, an additional diffusion treatment of 2750° F. for 50 hours and then rolled at 1600°–1500° F. to an 85% reduction in area.

Slices were then cut from the hot rolled ingot perpendicular to the rolling direction to provide samples for the measurement of tensile properties in the transverse direction. Samples were taken from both undefected and previously defected portions of the ingot. The results of the tensile tests are set forth in Table IV. Metallographic examination showed that the defected region had been completely dispersed; further, no cracking was observed.

EXAMPLE 14

In a manner similar to that described in Example 13, a 2.5 inch diameter sample of forged Ti-6Al-4V was seeded with granular natural hard alpha defect (3% N) material excised from a commercially processed Ti-6Al-4V forging. The sample was processed by HIP'ing at 1750° F. and 25 ksi for 3 hours, diffusion treated at 2650° F. for 40 hours, hot rolled 85% in the range of 1850° F. to 1550° F. and heat treated at 1750° F. for 1 hour (air cooled) and 1300° F. for 2 hours (air cooled). Slices cut from the heat treated ingot yielded tensile specimens which when tested produced the results reported in Table IV.

EXAMPLES 15 AND 15A

Figure 5:
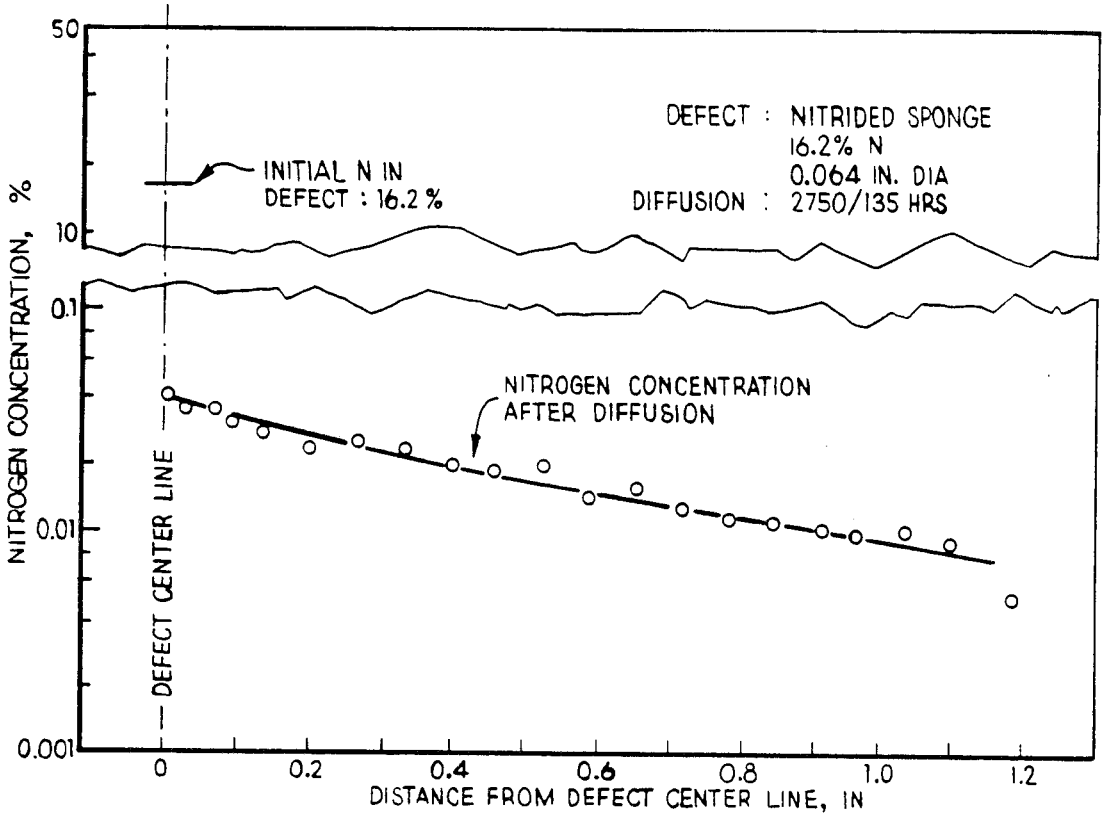
FIG. 5 is a graph of nitrogen concentration as a function of distance from the centerline of a seeded BS-6 defect in a Ti-17 matrix following HIP at 2500° F./15 ksi/3 hours and a diffusion treatment of 135 hours at 2750° F.
Figure 6:
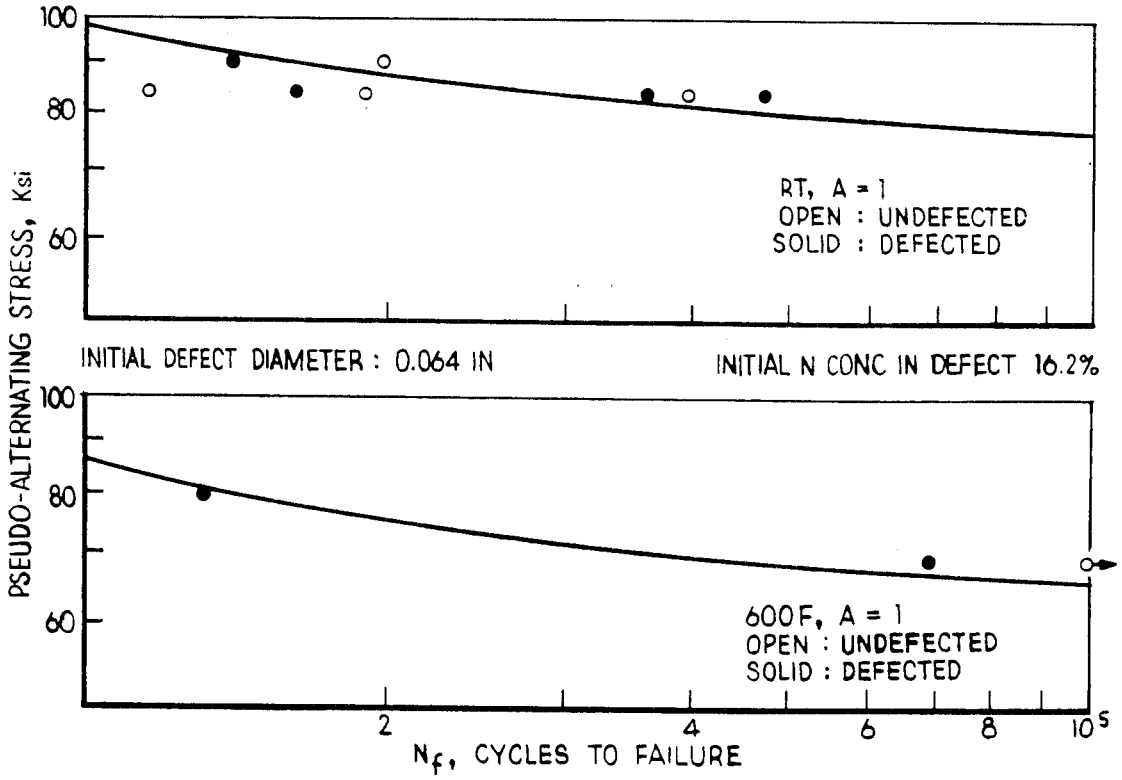
FIG. 6 is a graph of cycles to failure of defected and undefected regions of the specimens of Example 15 as a function of pseudo-alternating stress when tested at room temperature (RT) and 600° F.

Following the procedure described in Example 14, samples of Ti-17, produced by powder metallurgy techniques, were seeded with BS-6 defect material. The HIP treatment used was 2500° F./15 ksi/3 hours and the diffusion treatment was 2750° F. for 135 hours. FIG. 5 shows that the nitrogen concentration at the defect was reduced from 16% to 0.028%. Tensile test data for specimens from this ingot are also presented in Table IV. For comparison, one sample of Ti-17 containing no defects was similarly processed (Example 15A). As was the case in Examples 13 and 14, the method of the invention was effective in restoring the tensile properties of the previously defected regions to levels substantially equivalent to those of the undefected areas and the undefected ingot. Low cycle fatigue (LCF) specimens were also obtained from this sample and tested at room temperature (RT) and 600° F. The LCF data presented in FIG. 6 show comparable LCF properties between the defected and undefected parts of the rolled stock. Not shown, but more significant in showing effectiveness of the method of the invention, was the fact that all of the defected specimens failed away from the initial defect location.

TABLE IV

TENSILE PROPERTIES OF HARD-ALPHA-CONTAINING TITANIUM ALLOYS AFTER DEFECT DISPERSION BY HIP, DIFFUSION TREATMENT AND HOT ROLLING

| | | | Initial Interstitial Concentration In Defect | | Room Temperature Tensile Properties in Transverse Direction | | | | |
|---|---|---|---|---|---|---|---|---|---|
| Example | Base Alloy | Defect Material | N, % | O, % | Specimen Condition | UTS KSI | 0.2% YS KSI | EL. % | R.A. % |
| 13 | Ti 17 | BS-1 | 15.3 to 7.5 | 6.5 to 7.7 | Undefected | 174.9 | 173.9 | 8.1 | 16.9 |
| | | | | | | 173.1 | 171.1 | 10.0 | 38.8 |
| | | | | | Defected | 183.1 | 176.4 | 8.1 | 16.9 |
| | | | | | | 182.8 | 178.9 | 5.6 | 19.1 |
| 14 | Ti—6Al—4V | Hard Alpha Defect Extracted from forging | 3 | — | Undefected | 147.5 | 142.1 | 13.7 | 46.0 |
| | | | | | | 149.0 | 143.3 | 13.2 | 39.8 |
| | | | | | Defected | 149.8 | 142.2 | 14.3 | 41.7 |
| | | | | | | 150.3 | 142.8 | 10.7 | 28.5 |
| 15 | Ti 17 | BS-6 | 11.5 | 0.16 | Undefected | 183.1 | 181.1 | 11.7 | 23.4 |
| | | | | | | 179.0 | 172.0 | 11.2 | 20.3 |
| | | | | | Defected | 175.6 | 173.1 | 9.3 | 29.9 |
| | | | | | | 172.6 | 170.9 | 9.6 | 19.9 |
| 15A | Ti 17 | None | — | — | No Defect | 188.0 | 178.5 | 9.7 | 19.5 |
| | | | | | | 186.1 | 177.0 | 8.4 | 19.3 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method for the elimination of hard alpha defects from castings or ingots of titanium or titanium alloy comprising the steps of:
   (a) bringing the ingot or ingots to a substantially uniform temperature throughout of between about 2500° to about 2800° F.,
   (b) holding said ingot or ingots for a period of time sufficient to cause homogenization to occur between said hard alpha defects and the titanium or titanium alloy matrix, and
   (c) cooling said ingot or ingots from said substantially uniform temperature to room temperature or a lower temperature for further processing.

2. The method of claim 1 wherein said substantially uniform temperature is about 2700° F.

3. The method of claim 1 wherein said time sufficient to cause homogenization is from about 24 to about 200 hours.

4. The method of claim 3 wherein said time is about 100 hours.

5. The method of claim 1 wherein said substantially uniform temperature and said time sufficient to cause homogenization are interelated by the formula:

$$\text{time (hrs)} = [(C_i - C_f)/C_f](r^2/D)(1/3600)$$

where:
   $C_i$ is the initial max. nitrogen content in the defect (weight %);
   $C_f$ is the desired final max. nitrogen content after diffusion (weight %);
   r is the initial defect radius (cm); and
   D is the nitrogen diffusivity in the Ti alloy matrix ($cm^2$/sec).

6. The method of claim 1 wherein, prior to step (a), said castings or ingots are brought to a substantially uniform temperature in the range of from about 2200° to about 2500° F. and subjected to an isostatic pressure in the range of from about 10 to about 30 ksi for from about 2 to about 4 hours and thereafter proceeding with step (a).

7. The method of claim 6 wherein said substantially uniform temperature is about 2200° F.

8. The method of claim 6 wherein said isostatic pressure is about 15 ksi.

9. The method of claim 6 wherein said time is about 3 hours.

10. The method of claim 1 further including the step of mechanically working said ingot or ingots following step (c).

11. The method of claim 10 wherein said mechanical working step produces a reduction in the cross-sectional area of said ingot or ingots of at least about 50%.

12. The method of claim 11 wherein said reduction in cross-sectional area is at least about 60%.

13. A substantially inclusion-free, hard-alpha-free casting or ingot of titanium or titanium alloy made by the method of claim 1.

14. A substantially porosity-free, inclusion-free, and hard-alpha-free casting or ingot of titanium or titanium alloy made by the method of claim 6.

15. A substantially inclusion-free, hard-alpha-free ingot of titanium or titanium alloy made by the method of claim 10.

16. A method for the elimination of hard alpha defects from castings or ingots of titanium or titanium alloy comprising the steps of:

(a) bringing the ingot or ingots to a first substantially uniform temperature throughout of between about 2200° to about 2500° F., in the presence of an isostatic pressure in the range of from about 10 to 30 ksi for a period of about 2 to 4 hours, (b) increasing the temperature of said ingots to a second substantially uniform temperature throughout of between about 2500° to about 2800° F., (c) holding said ingot or ingots for a period of time sufficient to cause homogenization to occur between said hard alpha defects and the titantium or titanium alloy matrix, and (d) cooling said ingot or ingots from said substantially uniform temperature to room temperature or a lower temperature for further processing.

17. The method of claim 16 wherein said first substantially uniform temperature is about 2200° F.

18. The method of claim 16 wherein said isostatic pressure is about 15 ksi.

19. The method of claim 16 wherein said time for step (a) is about 3 hours.

20. The method of claim 16 wherein said second substantially uniform temperature is about 2700° F.

21. The method of claim 16 wherein said time sufficient to cause homogenization is from about 4 to about 400 hours.

22. The method of claim 21 wherein said time is about 100 hours.

23. The method of claim 16 wherein said substantially uniform temperature and said time sufficient to cause homogenization are interelated by the formula:

$$\text{time (hrs)} = [(C_i/C_f)/C_f](r^2/D)(1/3600)$$

where:

$C_i$ is the initial max. nitrogen content in the defect (weight %);

$C_f$ is the desired final max. nitrogen content after diffusion (weight %);

r is the initial defect radius (cm); and

D is the nitrogen diffusivity in the Ti alloy matrix ($cm^2/sec$).

24. The method of claim 16 further including the step of mechanically working said ingot or ingots following step (c).

25. The method of claim 24 wherein said mechanical working step produces a reduction in the cross-sectional area of said ingot or ingots of at least about 50%.

26. The method of claim 25 wherein said reduction in cross-sectional area is at least about 60%.

27. A substantially inclusion-free, hard-alpha-free ingot of titanium or titanium alloy made by the method of claim 24.

* * * * *